United States Patent [19]

Kawakami et al.

[11] 3,955,055

[45] May 4, 1976

[54] DYNAMIC LOUDSPEAKER

[75] Inventors: Hirotake Kawakami, Tokyo; Hiroshi Koizumi, Ohmiya, both of Japan

[73] Assignee: Sony Corporation, Tokyo, Japan

[22] Filed: Jan. 20, 1975

[21] Appl. No.: 542,378

[30] Foreign Application Priority Data

Jan. 31, 1974 Japan ..... 49-13549

[52] U.S. Cl. ..... 179/115.5 R; 181/173

[51] Int. Cl.[2] ..... H04R 9/06

[58] Field of Search ..... 179/115 R, 115.5 R, 179/181 R; 181/157, 163, 164, 165, 171, 172, 173, 174

[56] References Cited

UNITED STATES PATENTS 1,918,164 7/1933 Woolf et al. ..... 181/173

FOREIGN PATENTS OR APPLICATIONS 890,151 1/1944 France ..... 179/115.5 R 494,726 10/1938 United Kingdom ..... 181/32 R

*Primary Examiner*—Kathleen H. Claffy

*Assistant Examiner*—George G. Stellar

*Attorney, Agent, or Firm*—Hill, Gross, Simpson, Van Santen, Steadman, Chiara & Simpson

[57] ABSTRACT

A dynamic loudspeaker including a dome-type diaphragm having at least one convex surface and another concave surface, contiguous with the convex surface. Specifically, the concave surface is an annular portion surrounding the convex surface.

2 Claims, 3 Drawing Figures

DYNAMIC LOUDSPEAKER

BACKGROUND OF THE INVENTION

1. Field of the Invention:

This invention relates to a dynamic loudspeaker, and more particularly to a novel diaphragm construction for such a loudspeaker.

2. Description of the Prior Art:

Dynamic loudspeakers of the dome-type are one of the types of dynamic loudspeakers which are widely known. The dynamic loudspeaker of the dome-type comprises mainly a voice coil disposed in a magnetic circuit, and a dome-shaped diaphragm mechanically connected to the voice coil. In a dynamic loudspeaker, the diaphragm is shaped as a spherical segment with predetermined radius of curvature. The circumference of the diaphragm is fixed to a frame through an edge made of flexible material. For that reason, portions of the diaphragm in the vicinity of its circumference are less rigid and so are more flexible. Accordingly, divided vibrations occur at the portions of the diaphragm in the range of higher frequencies, for example, over 1 kHz. This causes a distorted sound. Undesirable peaks occur near the high threshold frequency in the response characteristics. Such loudspeakers are poor in directivity.

SUMMARY OF THE INVENTION

A dynamic loudspeaker according to this invention includes a dome-type diaphragm having at least one curved surface with radius of exterior curvature and another curved surface with radius of interior curvature.

Accordingly, it is an object of this invention to provide a loudspeaker with a novel diaphragm constructions.

Another object of this invention is to provide a loudspeaker in which portions of a dome-type diaphragm neighboring its circumference are strengthened in rigidity and accordingly divided vibrations are hard to occur.

A further object of this invention is to provide a loudspeaker in which portions of a dome-type diaphragm neighboring its circumference are strengthened in rigidity, and hence peaks near a high threshold frequency are removed, and good directivity is obtained.

A still further object of this invention is to provide a loudspeaker in which a dome-type diaphragm has at least one curved surface with radius of exterior curvature and another curved surface with radius of interior curvature, the dome-type diaphragm neighboring to the circumference of the diaphragm.

The above, and other objects, features and advantages of the invention, will be apparent in the following detailed description of illustrative embodiments thereof which is to be read in connection with the accompanying drawings.

DESCRIPTION OF THE PREFERRED EMBODIMENTS

Figure 1:
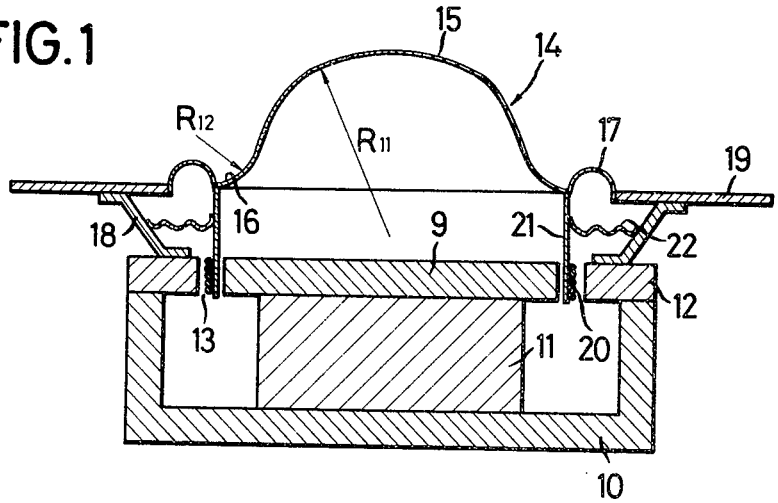
FIG. 1 is a schematic cross-sectional view of a dynamic loudspeaker of a preferred embodiment of this invention.

Referring now to the drawings, a magnet 11 with a generally circular pole piece 9 is provided and a corresponding complementary pole plate 12 having a central air gap 13 in general opposition to the circular pole piece 9. A magnet yoke 10 spans the distance between the pole plate 12 and the magnet 11 so as to provide a magnetic circuit.

A dome-shaped diaphragm 14 is provided which comprises a main curved surface 15 with radius $R_{11}$ of exterior curvature and is also provided with another curved surface 16 with radius $R_{12}$ of interior curvature, contiguous to the main curved surface 15. The radius $R_{12}$ is smaller than the radius $R_{11}$. The circumference of the curved surface 16 is connected to an edge 17 which is fixed to a frame 19. The frame 19 is fixed to the pole 12 through a supporting member 18. The diaphragm 14 is formed of, for example, paper, aluminum, cotton and suitable binder, with heating and pressing. A bobbin 21 is connected to the diaphragm 14. A voice coil 20 is attached to the bobbin 21 so as to be disposed in the air gap 13, as generally known. The bobbin 21 is supported by the supporting member 18 through a damper 22 on its circumferential surface. Thus, the diaphragm 14 is movably supported by the edge 17 and the damper 22.

According to this invention, since the diaphragm 14 is formed dome-shaped by the one curved surface 15 with radius of curvature and the other curved surface 16 with radius of the curvature opposite to the curvature of the curved surface 15, the rigidities of the circumferential portions of the diaphragm 14 are increased. Mechanical vibration is generated by the interaction of the magnetic flux from the magnet 11 and the currents flowing through the voice coil 20. The mechanical vibration is transmitted to the diaphragm 14 with fidelity. Accordingly, it will be understood that a divided vibration is hard to occur.

Figure 2:
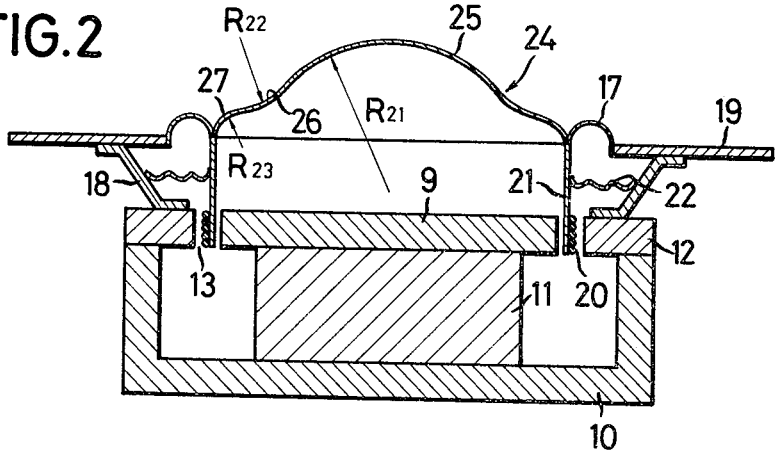
FIG. 2 is a schematic cross-sectional view of a dynamic loudspeaker of another preferred embodiment of this invention.

FIG. 2 shows another embodiment of this invention. A diaphragm 24 comprises a first curved surface 25 with radius $R_{21}$ of exterior curvature, a second curved surface 26 with radius $R_{22}$ of interior curvature contiguous to the first curved surface 25 and a third curved surface 27 with radius $R_{23}$ of exterior curvature contiguous to the second curved surface 26. The radius $R_{23}$ is smaller than the radius $R_{22}$. The other parts in FIG. 2 which correspond to the parts in FIG. 1, are denoted by the same reference numerals, and hence will not be described. The rigidity of the diaphragm 24 according to the embodiment of FIG. 2 is greater than that of the diaphragm 14 according to the embodiment of FIG. 1.

Figure 3:
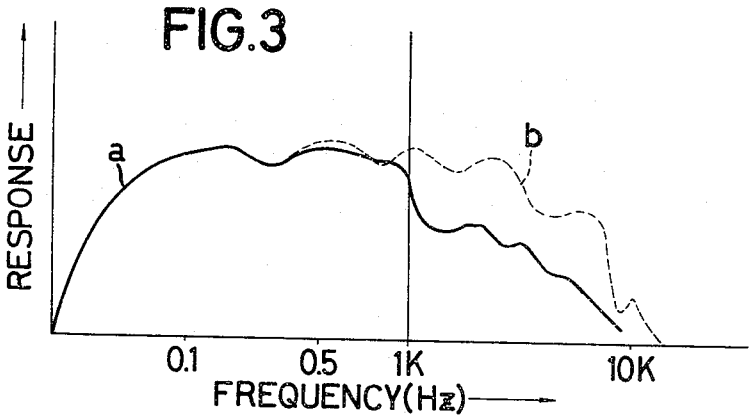
FIG. 3 is a graph showing a frequency response of the dynamic loudspeaker of FIG. 2.

FIG. 3 shows the frequency-response characteristics (curve *a*) of the dynamic loudspeaker having the diaphragm 24 according to the embodiment of FIG. 2. The curve a is nearly flat near the high threshold frequency, namely in the vicinity of 0.8 kHz. It will be understood that the divided vibration is damped. Curve b shows the frequency-response characteristics of the dynamic loudspeaker having the conventional dome-type diaphragm, where the dip or trough occurs near 0.8 kHz, or the peaks occur before and behind 0.8 kHz. Moreover, many divided vibrations occur in the range of the high frequencies over 1 kHz.

In the above-mentioned embodiments, the dynamic loudspeakers for low-pitched sounds have been described. However, this invention may be applied to dynamic loudspeakers for middle-pitched sounds and for high-pitched sounds, to obtain the same effects as the above-mentioned embodiments.

Although illustrative embodiments of the invention have been described in detail herein with reference to the accompanying drawings, it is to be understood that the invention is not limited to those precise embodiments, and that various changes and modifications may be effected therein without departing from the scope or spirit of the invention as defined in the appended claims.

We claim as our invention:

1. A dynamic loudspeaker comprising a magnet and yoke forming a magnetic circuit, an air gap in said magnetic circuit, a voice coil disposed in said air gap, and a diaphragm mechanically connected to said voice coil, said diaphragm including a first curved surface with predetermined radius of exterior curvature at its central portion, a second curved surface with predetermined radius of interior curvature, contiguous to said first curved surface, and a third curved surface with predetermined radius of exterior curvature contiguous to said second curved surface, the radius of exterior curvature of said first curved surface being larger than the radius of interior curvature of said second curved surface, the radius of exterior curvature of said third curved surface being smaller than the radius of interior curvature of said second curved surface, said first curved surface providing a principal dome-shaped central part of said diaphragm, and said voice coil being connected to said third curved surface.

2. A dynamic loudspeaker comprising a frame, a magnetic circuit comprised of a yoke having an air gap therein and a magnet, said yoke and magnet being mounted on said frame, a voice coil disposed for free movement in said air gap, and a diaphragm including a first curved surface with predetermined radius of exterior curvature, a second curved surface with predetermined radius of interior curvature contiguous to said first curved surface, and a third curved surface with predetermined radius of exterior curvature contiguous to said second curved surface, the radius of exterior curvature of said first curved surface being larger than the radius of interior curvature of said second curved surface, the radius of exterior curvature of said third curved surface being smaller than the radius of interior curvature of said second curved surface, said first curved surface providing a dome-shaped central part of said diaphragm, and said voice coil being carried by said third curved surface remote from said second curved surface, whereby divided vibrations are reduced by damping high frequency vibrations of said voice coil before they reach the central part of the diaphragm.

* * * * *